United States Patent [19]

Wacker et al.

[11] Patent Number: 4,813,363

[45] Date of Patent: Mar. 21, 1989

[54] OVERLOCK SEWING MACHINE WITH MECHANISM FOR CUTTING BROKEN THREADS

[75] Inventors: Niklaus Wacker, Berlingen; Hermann Moser, Diessenhofen, both of Switzerland

[73] Assignee: Fritz Gegauf AG Bernina-Nähmaschinenfabrik, Steckborn, Switzerland

[21] Appl. No.: 65,835

[22] Filed: Jun. 23, 1987

[30] Foreign Application Priority Data

Jul. 18, 1986 [CH] Switzerland ..... 2917/86

[51] Int. Cl.[4] ..... D05B 49/04; D05B 65/00

[52] U.S. Cl. ..... 112/242; 112/248; 112/298

[58] Field of Search ..... 112/242, 243, 248, 255, 112/285, 296, 298

[56] References Cited

U.S. PATENT DOCUMENTS

| | | | |
|---|---|---|---|
| 559,644 | 5/1896 | Weiss | 112/248 X |
| 2,718,204 | 9/1955 | Breul | 112/248 |
| 4,633,795 | 1/1987 | von Hagen | 112/248 |

FOREIGN PATENT DOCUMENTS

| | | | |
|---|---|---|---|
| 2913746 | 10/1980 | Fed. Rep. of Germany | 112/298 |
| 146313 | 2/1981 | German Democratic Rep. | 112/298 |
| 45-31983 | 10/1970 | Japan | 112/248 |

*Primary Examiner*—Wm. Carter Reynolds
*Attorney, Agent, or Firm*—Peter K. Kontler

[57] ABSTRACT

An overlock sewing machine wherein a thread which breaks between the shuttle and the looping discs is allowed to bypass the loop stripping device and is advanced by the discs toward and against the cutting edge of a knife provided on one leg of the U-shaped thread guide which confines the looping discs. This prevents the discs from convoluting the broken thread onto the shaft which drives the discs.

3 Claims, 2 Drawing Sheets

Fig. 3
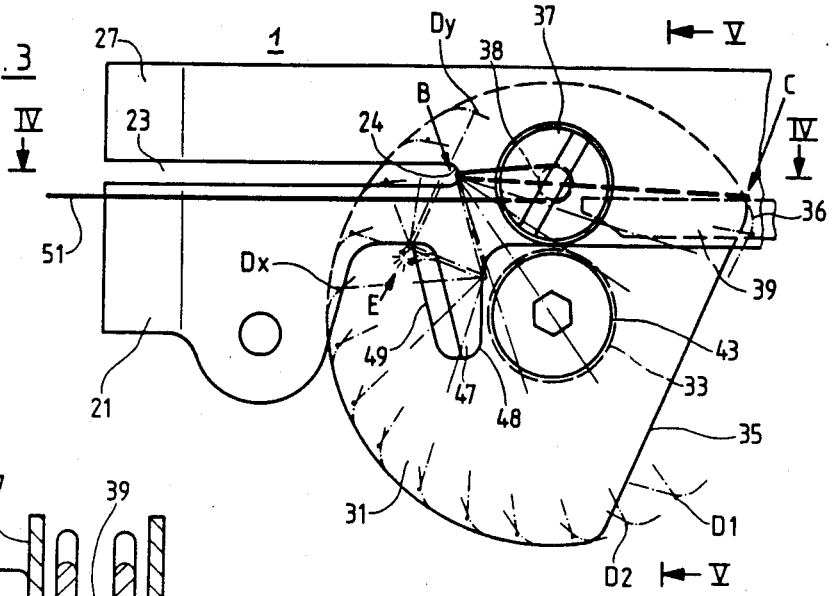
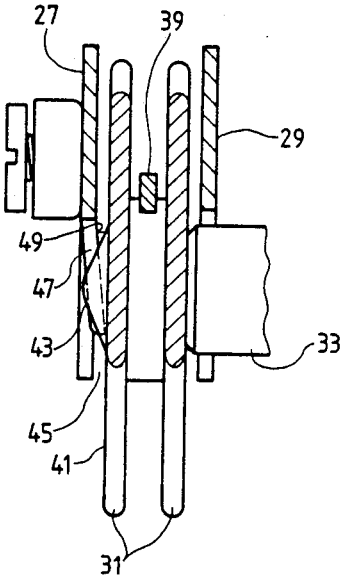
Fig. 5
Fig. 4
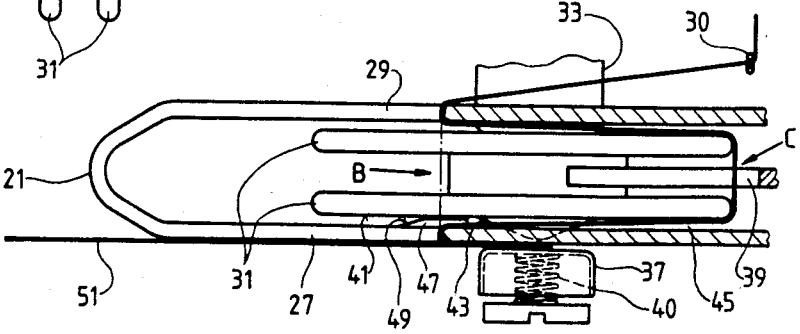

OVERLOCK SEWING MACHINE WITH MECHANISM FOR CUTTING BROKEN THREADS

BACKGROUND OF THE INVENTION

The invention relates to overlock sewing machines in general, and more particularly to improvements in mechanisms for severing threads in overlock sewing machines Overlock sewing machines are used for overedging, for cutting and overedging, for seaming and overedging, for roll hemming, for overlocking of several material layers and cross seams and/or for a number of other special operations of utilitarian and/or decorative nature. For example, an overlock sewing machine can be used for overedging and simultaneous formation of a two-thread chain stitch next to the edge. A so-called safety stitch, for example, of the type SSa-2 according to stitch type 516 (US Federal Standard No. 751a) consists of an edge stitch (stitch type 504) and a parallel stitch (stitch type 401) of the aforementioned US Federal Standard No. 751a.

During sewing, the warp thread of the parallel stitch is guided by a hook or shuttle which is caused to oscillate transversely of the direction of stitching. The hook cooperates with thread guide means and with a thread looping unit which rotates in synchronism with movements of the hook. The guide means includes a substantially U-shaped carrier for a device which tensions the yarn, and the carrier has guide slots for the thread as well as an eyelet through which the thread passes to be deflected in a predetermined direction, namely toward the hook. The legs of the U-shaped carrier flank two rotary entraining and looping discs which are coaxial with but spaced apart from each other to provide room for a thread stripping device which is secured to the frame of the sewing machine.

A thread which is stored in the form of a cone, spool or bobbin advances from the respective source through the thread tensioning device and thereupon transversely of the direction of rotation of the looping discs, through the slots in the legs of the carrier, toward the eyelet and thence to the hook or shuttle. The discs are positioned with reference to the carrier in such a way that the thread is adjacent their peripheral surfaces. When the shaft which carries the discs is set in rotary motion, flats at the peripheries of the discs engage the thread between the legs of the carrier and pull the thus engaged thread toward the stripping device which segregates the freshly looped portion of the thread from the discs and enables the hook or shuttle to advance a length of thread toward the needle. The same operation is repeated during each cycle.

If the thread happens to break, it is still likely to be engaged by the looping discs but the loop which is formed by such discs cannot be separated by the stripping device because the leader of the broken thread is no longer under tension. The broken thread is simply convoluted onto the shaft which drives the looping discs. This necessitates a lengthy interruption of operation of the sewing machine because the convolutions are not readily removable. In fact, the package of convoluted thread can cause damage to the carrier and/or to the looping discs.

OBJECTS AND SUMMARY OF THE INVENTION

An object of the invention is to provide an overlock sewing machine with novel and improved means for severing a broken thread close to the locus of the break so that the thread is severed before a considerable length of thread can be convoluted onto one or more rotary parts of the machine.

Another object of the invention is to provide a mechanism which can be installed in existing overlock sewing machines at a low cost and without necessitating any, or any appreciable, redesigning of the machine.

A further object of the invention is to provide a mechanism which does not interfere with normal operation of the machine, especially with normal progress of an unbroken thread, and which is not in the way to a person in charge of operating, repairing or inspecting the machine.

An additional object of the invention is to provide a novel and improved thread guide for use in the above outlined machine.

Still another object of the invention is to provide an overlock sewing machine which embodies the above outlined mechanism.

A further object of the invention is to provide a novel and improved method of severing broken threads in overlock sewing machines.

The invention resides in the provision of a multiple-thread overlock sewing machine with several thread sources. The machine comprises a pair of coaxial rotary thread entraining and looping members each of which can resemble a disc and each of which is preferably provided with a peripheral flat in register with the flat of the other member, and a preferably U-shaped thread guide having two portions (e.g., in the form of two substantially parallel legs made of metallic sheet material) flanking the looping members and provided with aligned thread-receiving slots. A thread which is drawn from one of the sources passes from the outside along one of the legs, through the slot of the one leg, over the looping members and into and outwardly through and beyond the slot in the other leg so that such thread is drawn off the source in response to rotation of the looping members and the thus formed loop is drawn between the two legs of the guide beyond the slots. The machine further comprises a thread stripping device which is disposed between the looping members and is positioned to separate the loop of an unbroken thread from the looping members in predetermined angular positions of such members but to permit the thread to advance with the looping members beyond the predetermined angular positions when the thread develops a break downstream of the slot in the other leg (because the broken thread is no longer under tension), and means for severing the broken thread which advances with the looping members beyond the predetermined angular positions.

The severing means can comprise a knife having a cutting edge located between the one leg of the guide and the adjacent looping member to sever the thread which is not stripped off the looping members. The slots are or can be substantially horizontal, and the cutting edge of the knife is then preferably located at a level below the slot in the one leg of the guide. The knife can be provided on the guide; in fact, the knife can constitute a projection which is an integral lug of the one leg.

The cutting edge of the knife is preferably inclined with reference to that side face of the aforementioned adjacent looping member which confronts the one leg of the guide. The looping members and the legs of the guide can be disposed in substantially parallel substantially vertical planes, and the one leg of the guide can define with the adjacent looping member a gap; the cutting edge of the knife preferably extends across such gap. The cutting edge is or can be substantially vertical.

The machine preferably further comprises means for diverting toward the cutting edge of the knife the broken thread which is advanced by the looping members beyond the predetermined angular positions. The diverting means can comprise a substantially conical protuberance on the side face of the aforementioned adjacent looping member.

The novel features which are considered as characteristic of the invention are set forth in particular in the appended claims. The improved sewing machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is an enlarged view of a detail in the sewing machine of FIG. 2;

FIG. 4 is a horizontal sectional view as seen in the direction of arrows from the line IV—IV of FIG. 3; and FIG. 5 is a vertical sectional view as seen in the direction of arrows from the line V—V of FIG. 3, with the thread omitted.

DESCRIPTION OF THE PREFERRED EMBODIMENTS

Figure 1:
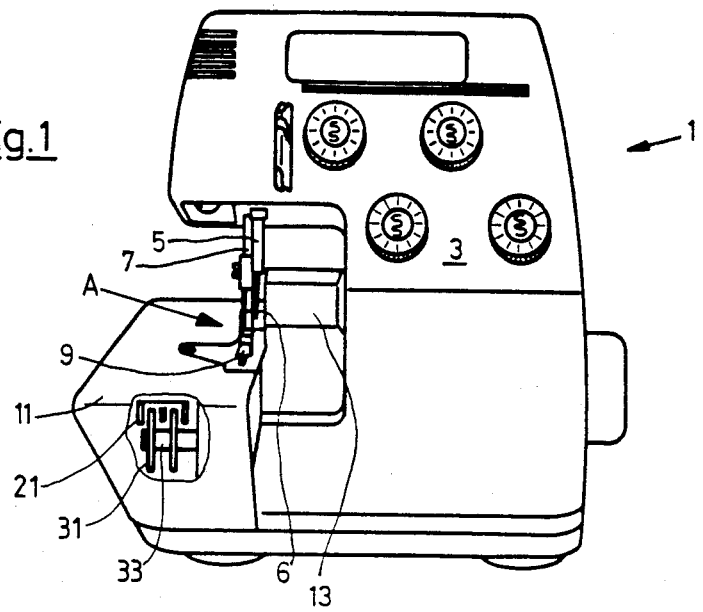
FIG. 1 is a front elevational view of an overlock sewing machine which embodies one form of the invention, with a portion of the housing broken away.
Figure 2:
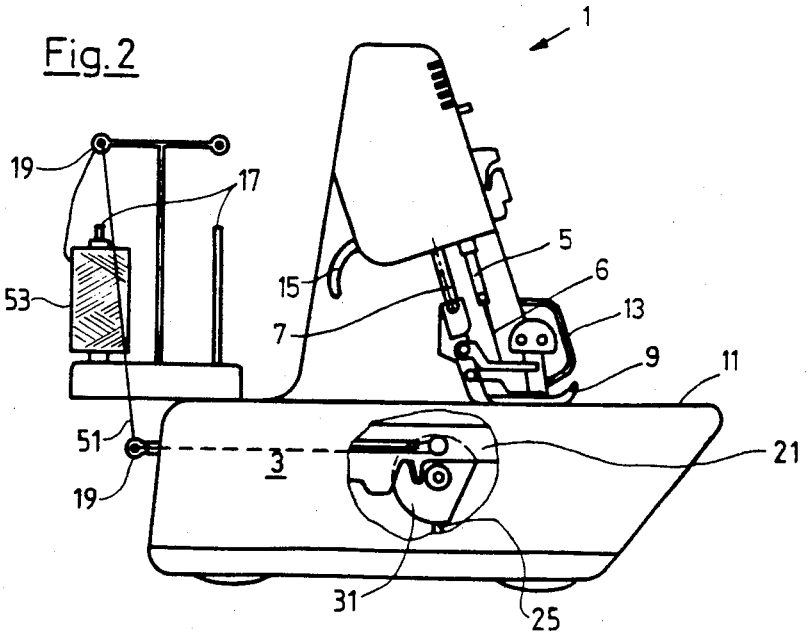
FIG. 2 is a side elevational view of the sewing machine as seen from the left-hand side of FIG. 1, with a portion of the housing broken away.

FIGS. 1 and 2 show an overlock sewing machine 1 similar to that which is known as Bernette MO-203 (manufactured and distributed by the assignee of the present application). The sewing machine 1 comprises a housing 3 having an upper section with a built-in carrying handle and supporting a needle bar 5 for a needle 6 which can be reciprocated by a conventional driving unit, not shown. The needle bar 5 is adjacent and parallel to a reciprocable presser bar 7 (disposed at A as seen in FIG. 1) which is also mounted in and is reciprocable in the upper section of the housing 3 and has a lower end portion carrying a presser foot 9. The underside of the presser foot 9 is substantially parallel to the top surface of a work plate 11 on the lower section of the housing 3. The needle bar 5 is further adjacent a selvage or edge cutter 13 which does not form part of the invention and is mounted at a level between the work plate 11 and the upper section of the housing 3. The means for guiding the needle bar 5 and the presser bar 7 in the upper section of the housing 3 are not shown because such features are not germane to the present invention. FIG. 2 further shows a presser foot lifter lever 15 at the rear side of the upper section of the housing 3.

The machine 1 can sew with several threads which are supplied by discrete spools, bobbins or cones (one shown at 53 in FIG. 2) at the rear side of the housing 3. The yarn or thread 51 which is supplied by the illustrated source 53 passes upwardly toward and through a guide 19 on the horizontal arm of a preferably telescopic supporting rod and thereupon downwardly toward and through a second guide 19 prior to entering the lower section of the housing 3 beneath the work plate 11. The reference character 17 denotes in FIG. 2 two spindles for discrete sources 53 of thread. The lower section of the housing 3 confines the means for building a supply of thread 51 as well as the novel and improved mechanism for cutting or trimming broken threads.

The means for building a supply of thread 51 which comes from the illustrated source 53 includes a substantially U-shaped carrier c,r guide 21 which can be made of a metallic sheet material and has two spaced-apart parallel portions or legs 27, 29 flanking two parallel disc-shaped rotary thread entraining or looping members 31. (Each of the legs 27, 29 has a rearwardly open substantially horizontal slot 23. The slots 23 are aligned with one another (see FIGS. 3 and 4), and the guide 21 is fixedly secured to a frame 25 in the interior of the lower section of the housing 3. The looping members 31 are secured to a driven horizontal shaft 33 which is mounted in the frame 25 at a level below the guide 21 at such a distance from the latter that only the upper portions of the members 31 extend into the space between the legs 27 and 29. The looping members 31 resemble circular discs save for the provision of two tangentially extending flats 35 which are disposed in a common plane extending in parallelism with the axis of the shaft 33.

The outer side of the leg 27 is adjacent a substantially cup-shaped thread tensioning element 37 which is mounted on the leg 27 forwardly of the innermost or deepmost (closed) portion 24 of the respective slot 23 and whose end wall is biased toward the outer side of the leg 27 by a coil spring 40. The bias of this spring can be regulated by a screw which is shown in FIGS. 3, 4 and 5.

The space between the looping members 31 accommodates a thread stripping device 39 whose upper side is located somewhat below the lowermost parts of the slots 23 and which projects into the space between the looping members toward but short of the shaft 38 for the tensioning element 37. The right-hand end portion of the thread stripping device 39 is mounted in the frame 25 in a manner which is not specifically shown in the drawing. That side face or surface 41 of the lower entraining member 31 of FIG. 4 which confronts the adjacent leg 27 of the thread guide 21 is provided with a substantially conical thread deflecting or diverting protuberance 43 whose axis coincides with the axis of the shaft 33 and which is located at a level below the leg 27. The protuberance 43 can constitute a screw which has an externally threaded shank extending into a tapped bore of the shaft 33 to secure the looping members 31 to such shaft. The apex of the protuberance 43 has a hexagonal socket for the working end of a suitable tool which is used to secure the protuberance to or to detach it from the shaft 33. The height of the protuberance 43 is preferably such that it completely spans the clearance or gap 45 between the side face 41 of the respective entraining member 31 and the inner side of the leg 27. This can be readily seen in FIG. 4.

The sewing machine 1 further comprises a knife 47 which is mounted on the guide 21, and more specifically on the leg 27, so that it is located rearwardly of the protuberance 43 and has an elongated cutting edge 49 facing toward the web of the guide 21, i.e., toward the sources of thread at the rear side of the housing 3. The illustrated knife 47 includes a projection or lug 48 which is an integral part of and extends downwardly from the leg 27. The cutting edge 49 is inclined with reference to the side face 41 of the lower entraining member 31 of FIG. 4 and extends across the space beneath the gap 45. The cutting edge 49 is or can be substantially vertical (see FIG. 3). If desired, the knife 47 can be produced as a separate part which is separably or permanently affixed (e.g., welded) to the leg 27 of the thread guide 21. This may be desirable if the knife 47 is to be installed in an existing overlock sewing machine.

The operation is as follows:

If the thread 51 is not broken, it extends from the source 53, through the two guides 19 of FIG. 2 and along the outer side of the leg 27 prior to being trained over the shaft 38 of the tensioning device 37 and entering the deepmost portion 24 of the slot 23 in the leg 27. At such time, the flats 35 of the entraining members 31 are substantially horizontal. The thread 51 then extends (at B) in parallelism with the axis of the shaft 33 toward and outwardly through the deepmost portion of the slot 23 in the leg 29 and thence toward and through an eyelet 30 which is shown in FIG. 4. The location of the eyelet 30 is or can be such that the portion of thread 51 between the deepmost portion of the slot 23 in the leg 29 and the eyelet 30 is substantially parallel to the outer side of the leg 29 (see FIG. 4). That portion of the thread 51 which advances beyond the eyelet 30 is engaged by a hook or shuttle, not shown, of conventional design.

If the disc-shaped looping members 31 are rotated in a clockwise direction, as seen in FIG. 3, the portion of thread 51 between the deepmost portions of the slots 23 in the legs 27, 29 of the thread guide 21 is engaged by the portions 36 of peripheral surfaces of the looping members and is pulled toward the location C (FIG. 3) whereby the members 31 cause the formation of a loop within the space which is provided between the legs 27, 29 and extends from the deepmost portions of the slots 23 to the location C where the thread is separated from the members 31 by the stripping device 39. This results in separation of the freshly formed loop from the members 31, and such loop can be pulled toward the aforementioned oscillating shuttle or hook in a well known manner.

If the thread 51 happens to break downstream of the slot 23 in the leg 29 of the thread guide 21, the thread is still engaged by the portions 36 of peripheral surfaces of the disc-shaped looping members 31 and these members cause the formation of a loop substantially in the same way as in the case of an unbroken thread, i.e., the thread portion which extends between the deepmost portions of the slots 23 is pulled toward the location C in response to clockwise rotation of the shaft 33. However, and since the leader of the broken thread is not under tension, it is not stripped off the looping members 31 by the device 39. Such thread is advanced with the portions 36 to the positions D1, D2 and so on to the position Dx of FIG. 3. The thread is deflected or diverted by the conical protuberance 43 and is looped over the knife 47 in a manner as shown in FIG. 3 to be severed by the cutting edge 49 at the location E as soon as the portions 36 of the looping members 31 reach the location Dy. The thus separated length of the thread 51 cannot be convoluted onto the shaft 33 which simplifies removal of severed thread from the machine 1.

An important advantage of the improved severing mechanism is that a broken thread is severed close to the locus of the break before a considerable length of broken thread can be convoluted onto the shaft 33. This reduces the likelihood of damage to the looping members 31 during winding of broken thread onto the drive shaft 33 as well as during unwinding of accumulated thread from the shaft 33.

Another important advantage of the improved mechanism is that it can be installed in existing overlock sewing machines at a minimal cost, either by attaching a separately produced knife 47 to the leg 27 of the guide 21 or by replacing a conventional thread guide with a guide 21 which has a leg 27 with an integral projection constituting a lug 48 and serving as a knife with a cutting edge 49 oriented in a manner as described above. The knife does not interfere in any way with advancement of the thread 51 toward the shuttle when the thread is intact, i.e., when its loops can be stripped off the members 31 by the device 39 as soon as the portions 36 of members 31 reach the location C of FIG. 3. In addition, the knife 47 does not interfere with the manipulation and/or servicing of the machine 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a multiple-thread overlock sewing machine with several thread sources, the combination of a pair of coaxial rotary thread entraining and looping members; a thread guide having two portions flanking said members and provided with thread-receiving slots, a thread which is drawn from one of said sources passing from the outside along one of said portions, through the slot of said one portion, over said members and into and outwardly through the slot of the other of said portions so that such thread is drawn off the source in response to rotation of said members and the resulting loop is drawn between said portions beyond said slots; a thread stripping device disposed between said members and arranged to separate the loop of an unbroken thread from said members in predetermined angular positions of said members but to permit the looped thread to advance with said members beyond said angular positions when the thread develops a break downstream of the slot in said other portion; and means for severing the broken thread which advances with said members beyond said angular positions, said severing means including a knife having a cutting edge between said one portion of said guide and the adjacent entraining and looping member to cut the thread which is not stripped off said members, and said adjacent member having a side face confronting said one portion of said guide, said cutting edge being inclined with reference to said side face, and said members and said portions of said guide being disposed in substantially parallel substantially vertical planes, said one portion of said guide and said adjacent member defining a gap, and said cutting edge extending across said gap.

2. In a multiple-thread overlock sewing machine with several thread sources, the combination of a pair of coaxial rotary thread entraining and looping members; a thread guide having two portions flanking said members and provided with thread-receiving slots, a thread which is drawn from one of said sources passing from the outside along one of said portions, through the slot of said one portion, over said members and into and outwardly through the slot of the other of said portions so that such thread is drawn off the source in response to rotation of said members and the resulting loop is drawn between said portions beyond said slots; a thread stripping device disposed between said members and arranged to separate the loop of an unbroken thread from said members in predetermined angular positions of said members but to permit the looped thread to advance with said members beyond said angular positions when the thread develops a break downstream of the slot in said other portion; means for severing the broken thread which advances with said members beyond said angular positions, said severing means including a knife having a cutting edge between said one portion of said guide and the adjacent entraining and looping member to cut the thread which is not stripped off said members; and means for diverting toward said cutting edge the broken thread which is advanced by said members beyond said angular positions.

3. The combination of claim 2, wherein said diverting means comprises a protuberance on said adjacent member.

* * * * *